US008126359B2

(12) United States Patent
Calamita et al.

(10) Patent No.: US 8,126,359 B2
(45) Date of Patent: Feb. 28, 2012

(54) USE OF XEROGRAPHIC IMAGES AND A FULL-WIDTH ARRAY SENSOR FOR MULTIPLE CONTROL SYSTEM SENSING

(75) Inventors: James P. Calamita, Spencerport, NY (US); Michael John Martin, Hamlin, NY (US); Douglas R. Taylor, Webster, NY (US); Shawn P. Updegraff, Fairport, NY (US); Brian R. Conrow, Webster, NY (US); David C. Craig, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 623 days.

(21) Appl. No.: 12/173,448

(22) Filed: Jul. 15, 2008

(65) Prior Publication Data

US 2010/0014896 A1 Jan. 21, 2010

(51) Int. Cl.
*G03G 15/02* (2006.01)

(52) U.S. Cl. ..... 399/116; 399/72; 399/301

(58) Field of Classification Search ..... 399/72; 347/116

See application file for complete search history.

(56) References Cited

U.S. PATENT DOCUMENTS 5,278,589 A 1/1994 Wong
5,365,074 A 11/1994 Genovese
5,418,556 A 5/1995 Andrews
5,438,354 A 8/1995 Genovese
5,546,165 A 8/1996 Rushing et al.
6,275,244 B1 8/2001 Omelchenko et al.
6,300,968 B1 10/2001 Kerxhalli et al.
6,493,011 B1 12/2002 Shioya
6,904,255 B2 6/2005 Kera et al.
6,975,949 B2 * 12/2005 Mestha et al. ..... 702/76
7,038,816 B2 5/2006 Klassen et al.
7,095,531 B2 8/2006 Mizes et al.
7,120,369 B2 10/2006 Hamby et al.
7,177,585 B2 2/2007 Matsuzaka et al.
2004/0227966 A1 * 11/2004 Lee ..... 358/1.9
2006/0071963 A1 * 4/2006 Sampath et al. ..... 347/19
2008/0063417 A1 3/2008 Elliot et al.
2009/0322849 A1 * 12/2009 Calamita et al. ..... 347/232

* cited by examiner

*Primary Examiner* — David Gray
*Assistant Examiner* — Roy Y Yi
(74) *Attorney, Agent, or Firm* — Pillsbury Winthrop Shaw Pittman LLP

(57) ABSTRACT

A method for monitoring an image printing system that prints color images on an image bearing surface movable in a process direction is provided. The method includes placing marking material to form a row comprising a plurality of registration marks on the image bearing surface, wherein each row of registration marks extends along a cross-process direction transverse to the process direction; detecting a position of each registration mark using a linear array sensor extending in the cross-process direction, wherein the position of each registration mark is detected in both the process and cross-process direction; determining a process direction misregistration between the registration marks of each row in the process direction and cross-process direction misregistration between registration marks from each of the rows.

20 Claims, 7 Drawing Sheets

USE OF XEROGRAPHIC IMAGES AND A FULL-WIDTH ARRAY SENSOR FOR MULTIPLE CONTROL SYSTEM SENSING

BACKGROUND

1. Field

The present disclosure relates to a system and a method for using a common set of multi-purpose images for streak detection, color density, and color-to-color registration in an image printing system.

2. Description of Related Art

In various reproduction systems, including xerographic printing, the control and registration of the position of an image bearing surface, such as photoreceptor belts, intermediate transfer belts, or images thereon, is important. It is well known to provide various single or dual axes control systems, for adjusting or correcting the cross-process position or process position or timing of a photoreceptor belt or other image bearing surface of an image printing system, such as by belt lateral steering systems or belt drive motor controls. It is also known to adjust or correct the cross-process position or process position or timing of the placing of images on the image bearing surface with adjustable image generators such as laser beam scanners.

An important application of such accurate image position or registration systems is to accurately control the positions of different colors being printed on the same intermediate or final image substrate, to insure the positional accuracy (adjacency or overlapping) of the various colors being printed. That is not limited to xerographic printing systems. For example, precise registration control may be required over different ink jet printing heads or vacuum belt or other sheet transports in a plural color ink jet printer.

It is well known to provide, image registration systems for the correct and accurate alignment, relative to one another, on both axes (the cross-process direction axis or the process direction axis), of different plural color images on an initial imaging bearing surface member, such as (but not limited to) a photoreceptor belt of a xerographic color printer. These image registration systems improve the registration accuracy of such plural color images relative to one another or to the image bearing surface, so that the different color images may be correctly and precisely positioned relative to one another or superposed and combined for a composite or full color image. Further, these image registration systems provide for customer-acceptable color printing on a final image substrate such as a sheet of paper. The individual primary color images to be combined for a mixed or full color image are often referred to as the color separations.

Color registration systems for printing, as here, should not be confused with various color correction or calibration systems, involving various color space systems, conversions, or values, such as color intensity, density, hue, saturation, luminance, chrominance, or the like, as to which respective colors may, be controlled or adjusted. Color registration systems, such as that disclosed herein, relate to positional information and positional correction (shifting respective color images in the cross-process direction or in the process direction or providing image rotation or image magnification) so that different colors may be accurately superposed or interposed for customer-acceptable full color, intermixed color, or accurately adjacent color printed images. The human eye is particularly sensitive to small printed color misregistrations of one color relative to one another in superposed or closely adjacent images, which can cause highly visible color printing defects such as color bleeds, non-trappings (white spaces between colors), halos, ghost images, etc.

Known means to adjust the registration of the images on either or both axes relative to the image bearing surface and one another include adjusting the position or timing of the images being formed on the image bearing surface. That may be done by control of ROS (raster output scanner) laser beams or other known latent or visible image forming systems.

In particular, it is known to provide such imaging registration systems by means of marks-on-belt (MOB) systems, in which edge areas of the image bearing surface laterally outside of its normal imaging area are marked with registration positional marks, detectable by an optical sensor. For belt steering and motion registration systems (previously described) such registration marks can be permanent, such as by silk screen printing or otherwise permanent marks on the belt, such as belt apertures, which may be readily optically detectable. However, for image position control relative to other images on the belt, or the belt position, especially for color printing, these registration marks are printed and not permanent marks. Typically, they are distinctive marks printed with, and adjacent to, the respective image, and developed with the same toner or other developer material as is being used to develop the associated image, in positions corresponding to, but outside of, the image position. For example, the marks may be printed along the side of the image position or in the inter-image zone between the images for two consecutive prints. Such marks-on-belt (MOB) image position or registration indicia are thus typically repeatedly developed and erased in each rotation of the image bearing surface. It is normally undesirable, of course, for such registration marks to appear on the final prints (on the final image substrate).

In the marks-on-belt (MOB) system, the measurements are taken at two or more lateral or cross-process positions. This is because the marks-on-belt (MOB) sensors are fairly expensive. Therefore, it is desirable to eliminate the use of the marks-on-belt (MOB) sensors and have their function performed by other, less expensive and higher resolution means.

The present disclosure proposes a method and a system to measure the misregistration between the colors. The present disclosure uses a linear array sensor as a color registration sensor, and replaces the chevron ensembles that are used in the marks-on-belt (MOB) systems with a plurality of registration marks (e.g., corresponding to each color separation in a color model) on the image bearing surface.

SUMMARY

In an embodiment, a method for monitoring an image printing system that prints color images on an image bearing surface movable in a process direction is provided. The method includes placing a marking material to form of a row comprising a plurality of registration marks on the image bearing surface, detecting a position of each registration mark using a linear array sensor extending in the cross-process direction, determining a process direction misregistration between the registration marks of each row in the process direction, and determining a cross-process direction misregistration between registration marks from each of the rows. Each row of registration marks extends along a cross-process direction transverse to the process direction. The position of each registration mark is detected in both the process and cross-process directions.

In another embodiment, an image printing system is provided. The image printing system includes a print engine, a linear array sensor, and a processor. The print engine is configured to place a marking material to form a row comprising a plurality of registration marks on the image bearing surface. Each row of registration marks is extending along a cross-process direction transverse to the process direction. The linear array sensor is extending in a cross-process direction and is adjacent to the image bearing surface. The linear array sensor is configured to detect a position of each registration mark. The position of each registration mark is detected in both the process and cross-process directions. The processor is configured to determine (a) a process direction misregistration between the registration marks of each row in the process direction; and (b) a cross-process direction misregistration between registration marks from each of the rows.

Other objects, features, and advantages of one or more embodiments will become apparent from the following detailed description, and accompanying drawings, and the appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 1:
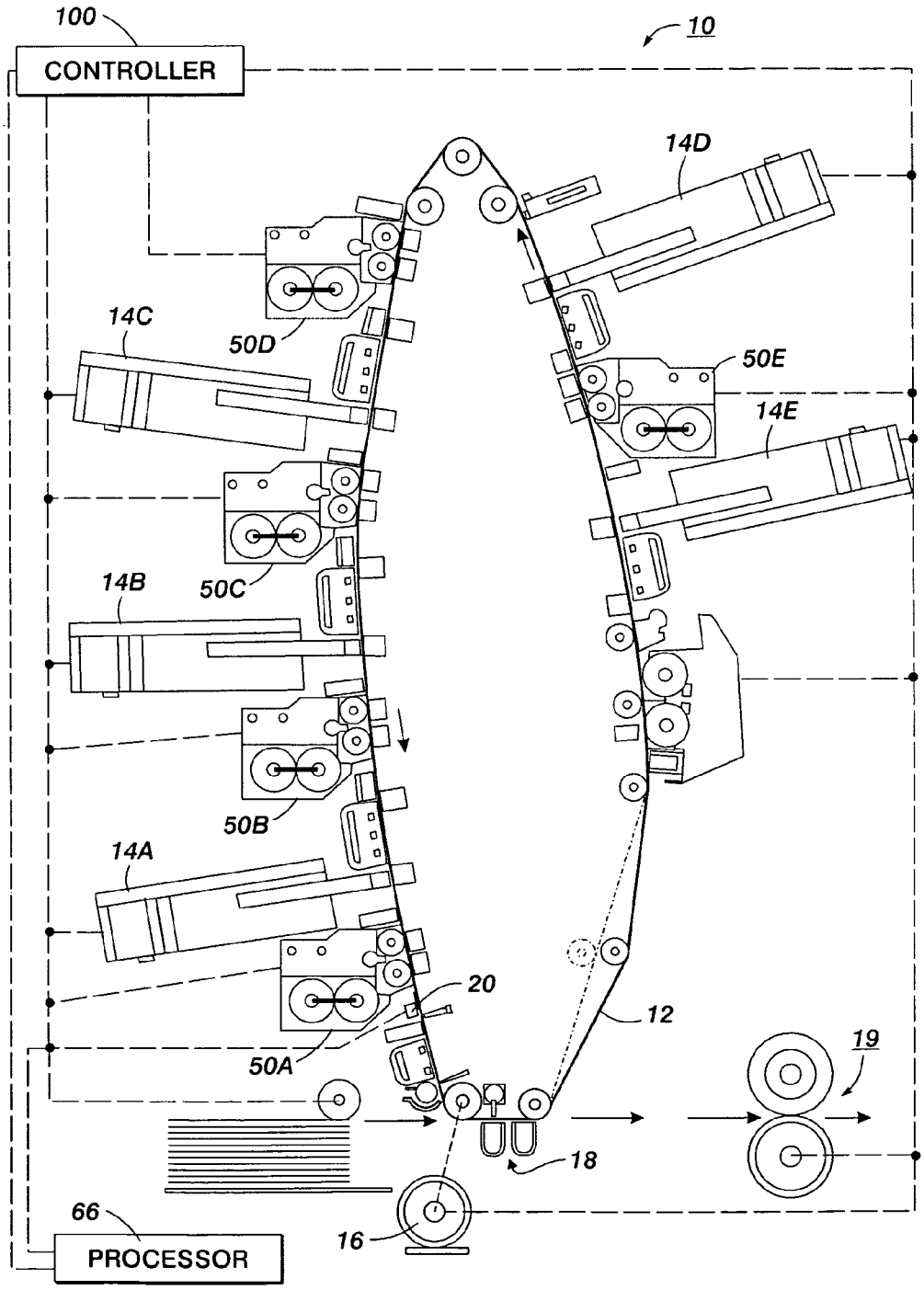
FIG. 1 shows a schematic front view of an image printing system incorporating a color registration system.

FIG. 1 schematically illustrates a printer 10 as one example of an otherwise known type of xerographic, plural color "image-on-image" (IOI) type full color (cyan, magenta, yellow and black imagers) reproduction machine, merely by way of one example of the applicability of the present disclosure. A partial, very simplified, schematic perspective view thereof is provided in FIG. 2. This particular type of printing is also referred as "single pass" multiple exposure color printing. The printer generally uses a Raster Output Scanner (ROS) to expose the charged portions of an image bearing surface and to record an electrostatic latent image on the image bearing surface. Further examples and details of such IOI systems are described in U.S. Pat. Nos. 4,660,059; 4,833,503; and 4,611,901, the entirety of which is incorporated herein by reference.

U.S. Pat. Nos. 5,418,556; 6,275,244; and 6,300,968, the entirety of which is incorporated herein by reference, describe prior approaches for accurate color registration of color images.

However, it will be appreciated that the disclosed improved registration system could also be employed in non-xerographic color printers, such as ink jet printers, or in "tandem" xerographic or other color printing systems, typically having plural print engines transferring respective colors sequentially to an intermediate image transfer belt and then to the final substrate. Thus, for a tandem color printer (e.g., U.S. Pat. Nos. 5,278,589; 5,365,074; 6,904,255 and 7,177,585, each of which are incorporated by reference) it will be appreciated that the image bearing surface on which the subject registration marks are formed may be either or both on the photoreceptor and the intermediate transfer belt, and have linear array sensors and image position correction systems appropriately associated therewith. Various such known types of color printers are further described in the above-cited patents and need not be further discussed herein.

Figure 2:
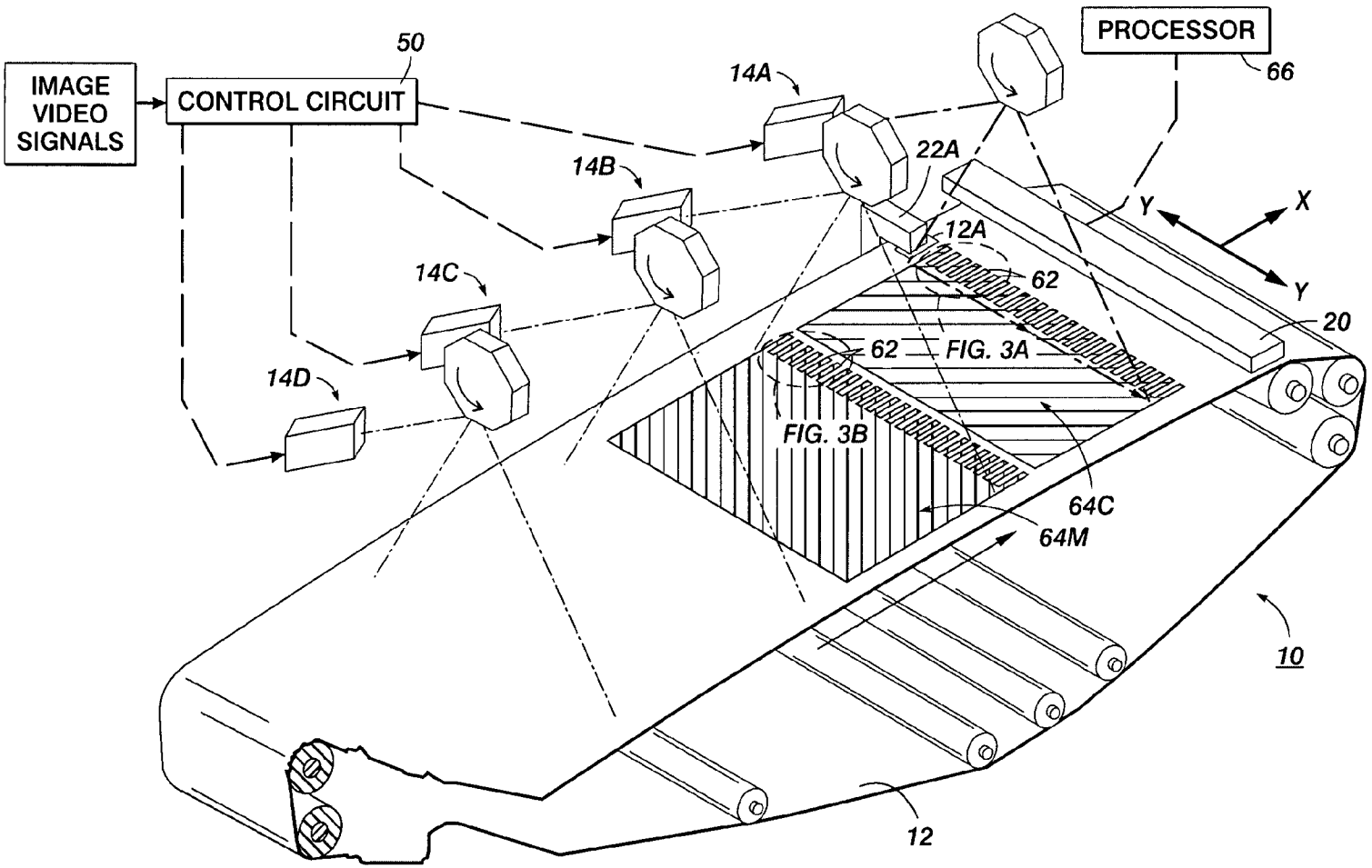
FIG. 2 shows a simplified schematic perspective view of part of the embodiment of FIG. 1 for better illustrating exemplary sequential ROS generation of plural color latent images and associated exemplary latent image registration marks for sensing by a linear array sensor (with development stations, etc., removed for illustrative clarity) in accordance with an embodiment of the present disclosure.

Referring to the exemplary printer 10 of FIGS. 1 and 2, all of its operations and functions may be controlled by programmed microprocessors, as described above, at centralized, distributed, or remote system-server locations, any of which are schematically illustrated here by the controller 100. A single image bearing surface 12 may be successively charged, ROS imaged, and developed with black or any or all primary colors toners by a plurality of imaging stations. In this example, these plural imaging stations include respective ROS's 14A, 14B, 14C, 14D, and 14E; and associated developer units 50A, 50B, 50C, 50D, and 50E. In the illustrated embodiment, a five-color version of the image printing system is shown. A composite plural color imaged area 30, as shown in FIG. 2, may thus be formed in each desired image area in a single revolution of the image bearing surface 12 with this exemplary printer 10, providing accurate registration. A linear array sensor 20 is schematically illustrated, and will be further described herein concerning such registration.

In one embodiment, the image bearing surface 12 is at least one of a photoreceptor drum, a photoreceptor belt, an intermediate transfer belt, an intermediate transfer drum, and other image bearing surfaces. That is, the term image bearing surface means any surface on which a toner image is received, and this may be an intermediate surface (i.e., a drum or belt on which an image is formed prior to transfer to the printed document). In one embodiment, the image bearing surface 12 may include a conventional drive system 16 for moving the image bearing surface 12 in the process direction shown by its movement arrows. A conventional transfer station 18 is illustrated for the transfer of the composite color images to the final substrate, usually a paper sheet, which then is fed to a fuser 19 and outputted.

The color images on the image bearing surface 12 are color separations of a color model being accurately superimposed to form full color images. In one embodiment, these color images are developed successively on the image bearing surface 12 before being transferred to a sheet of paper.

The present disclosure described the color registration system using a CMYK (cyan, magenta, yellow, black) color model. However, it is contemplated that the present disclosure is not limited to CMYK color model. In one embodiment, the color model is selected from the group consisting of RGB (red, green, blue) color model, CMY (cyan, magenta, yellow) color model, CMYK (cyan, magenta, yellow, black) color model, HSB (Hue, Saturation, Brightness) color model, HLS (Hue, Lightness, Saturation) color model, and CIE L*a*b (Lab) color model. In one embodiment, for example in the case of the CMYK color model, developer units 50A-D are used to develop black, cyan, yellow, and magenta, color images respectively on the image bearing surface 12 before being transferred to a sheet of paper.

Referring to FIG. 2, it may be seen that registration hole 12A may be provided along one or both edges of the photoreceptor belt 12. This hole or mark may be optically detected, such as by belt hole sensor, schematically shown in this example in FIG. 2 as 22A.

The image printing system generally has two important dimensions: the process (or slow scan) direction and the cross-process (or fast scan) direction. The direction in which the image bearing surface 12 moves is referred to as process (or slow scan) direction, and the direction that is transverse or perpendicular to the process direction (e.g., in which the plurality of sensors are oriented) is referred to as cross-process (or fast scan) direction. In the illustrated embodiment, the X-direction represents process (or slow scan) direction and the Y-direction represents cross-process (or fast scan) direction.

As shown in FIG. 2, a row 60 with a plurality of registration marks 62 adjacent to each toner image 64C or 64M (e.g., corresponding to cyan and magenta color separations of CMYK color model) is placed (e.g., using a marking material) on the image bearing surface 12. In illustrated embodiment, the row 60 of registration marks 62 is placed along the width of the image bearing surface 12. Each row 60 of registration marks 62 extends along the cross-process direction (e.g., Y direction) transverse to the process direction (e.g., X direction). Each row 60 of registration marks 62 is placed (e.g., using the marking material) in the same color as its adjacent toner image 64C or 64M. In one embodiment, a row of registration marks and a toner image are placed (e.g., using the marking material) for each color separation in the color model. For example, in the case of the CMYK color model, a row with a plurality of registration marks and a toner image are placed (e.g., using the marking material) for each of Cyan, Magenta, Yellow and Black colors. The illustrated embodiment shows toner images and rows of registration marks place (e.g., using the marking material) for Cyan and Magenta colors.

The illustrated embodiment disclosed a plurality of registration marks adjacent to each toner image. However, it is contemplated that a plurality of rows of registration marks may be placed (e.g., using the marking material) on the image bearing surface adjacent to each other, without the toner image described earlier separating them. In such embodiment, each row of registration marks may be placed for each of Cyan, Magenta, Yellow and Black colors (e.g., in the case of a CMYK model).

In one embodiment, the toner image 64C or 64M is in the form of a test patch or a test pattern located on the image bearing surface 12. In one embodiment, a customized test pattern, which can be a series of evenly spaced patches, may be used to monitor a property of the toner image using a sensor. In one embodiment, the test pattern contemplated may take a variety of forms but preferably takes the form of a recognizable bar code or sequence of colors in a convenient arrangement. In one embodiment, the toner image is deterministic in nature. The deterministic nature of the toner image refers to the fact that the toner images are printed on the image bearing surface at a known time and a known location.

Figure 3A:
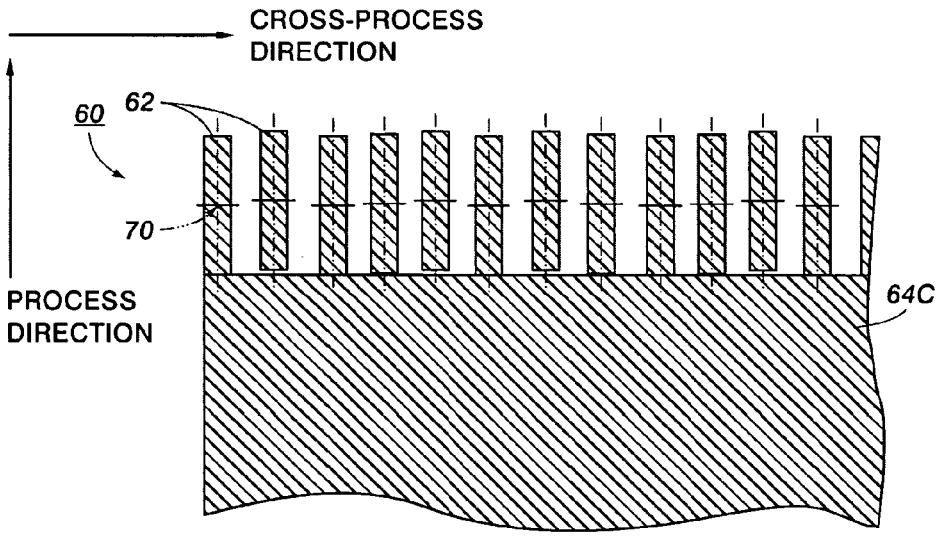
FIG. 3A shows a detailed view of registration marks and toner image for cyan color separation in the CMYK color model in accordance with an embodiment of the present disclosure.
Figure 3B:
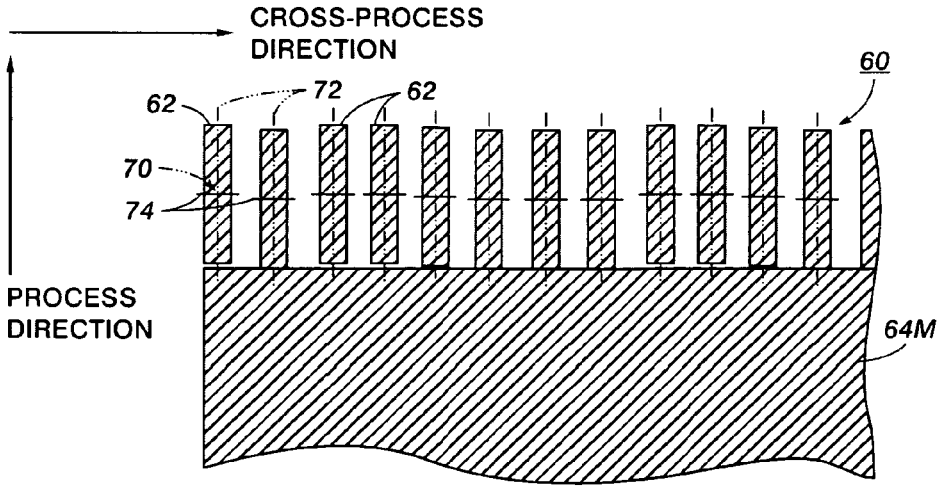
FIG. 3B shows a detailed view of registration marks and toner image for magenta color separations in the CMYK color model in accordance with an embodiment of the present disclosure.

In the illustrated embodiment, as shown in FIG. 3A and 3B, the geometric center of each registration mark 62 is indicated by cross-hairs 70, which are not printed, but calculated as part of the correction algorithm. In another embodiment, the particular shape of the registration marks is not important to the present disclosure. These registration marks are used to ensure that images formed on the image bearing surface at different color stations are aligned with each other, and particularly to ensure that each mark is formed in the appropriate position. When printing multi-color documents it is important to keep the colors aligned.

The present disclosure proposes a color registration system that utilizes the linear array sensor 20 to detect the plurality of registration marks (e.g., corresponding to a color separation of a color model) on the image bearing surface 12. A position of each registration mark 62 is detected using the linear array sensor 20. The position of each registration mark 62 is detected in both process and cross-process directions. In one embodiment, the position of each registration mark 62 includes a cross-process direction coordinate in the cross-process direction, and a process direction coordinate in the process direction. In one embodiment, the cross-process direction coordinate and the process direction coordinate of each registration mark 62 are determined at the intersection of straight lines 72 and 74 of the cross mark 70 (i.e., the line centers of the registration marks).

Preferably, the linear array sensor 20 is, for example, a full width array (FWA) sensor. A full width array sensor is defined as a sensor that extends substantially an entire width (e.g., perpendicular to a direction of motion) of the moving image bearing surface 12. In one embodiment, the linear array sensor 20 is extending in the cross-process direction. In one embodiment, the full width array sensor is configured to detect any desired part of the printed image, while printing real images. The full width array sensor may include a plurality of sensors equally spaced at intervals (e.g., every 1/600th inch (600 spots per inch)) in the cross-process (or a fast scan) direction. See for example, U.S. Pat. No. 6,975,949, incorporated herein by reference. It is understood that other linear array sensors may also be used, such as contact image sensors, CMOS array sensors or CCD array sensors. Although the full width array sensor or contact sensor is shown in the illustrated embodiment, it is contemplated that the present disclosure may use sensor chips that are significantly smaller than the width of the image bearing surface, through the use of reductive optics. In one embodiment, the sensor chips may be in the form of an array that is one or two inches long and is configured to detect the entire area across the image bearing surface through the reductive optics. In one embodiment, a processor may be provided to both calibrate the linear array sensor and to process the reflectance data detected by the linear array sensor. It could be dedicated hardware like ASICs or FPGAs, software, or a combination of dedicated hardware and software.

In one embodiment, a processor 66 is configured to process the reflectance data received from the linear array sensor 20 and to determine the process direction misregistration (e.g., registration error in the process direction) and cross-process direction misregistration (e.g., registration error in the cross-process direction). The process direction misregistration is the difference between the registration marks of each row in the process direction, and the cross-process direction misregistration is the difference between registration marks from each of the rows. In one embodiment, the processor 66 determines the registration error in the cross-process direction relative to a reference color separation of a color model. In such embodiment, the registration of the reference color relative to a fixed location on the image printing system in the process direction is determined. In one embodiment, the color registration system is a four color registration system, for example, in the case of the CMYK color model. In such embodiment, the reference color separation is Cyan color. In one embodiment, the processor 66 is also configured to calculate a correction function based on the registration errors in process and cross-process directions. In one embodiment, the correction function provides accurate registration of color images on the image bearing surface. In one embodiment, as shown in FIG. 1, the controller 100 is coupled to the processor 66 and is configured to control each color registration actuator based on the correction function calculated from the process direction misregistration and cross-process direction misregistration.

For the cross-process misregistration, in addition to the difference between the registration marks from each of the rows, an offset in the process direction is also accounted. In one embodiment, the offset is known and is generally an absolute position of a reference color image (e.g., Cyan color for a CMYK color model) with respect to a fixed position of an image printing device in the process direction. All of the other colors (e.g., Magenta, Yellow and Black in case of the CMYK color model) are set relative to the reference color (e.g., Cyan color in case of a CMYK color model). In one embodiment, the offset is known by an image printing system setup procedure where the reference color is set relative to paper (IOP, Image-on-Paper) setup. For example, a page is printed out with registration marks printed in the reference color. The user measures these relative to each other and relative to the paper edge. These measurements are manually input into the machine to fix the reference color location.

Figure 4:
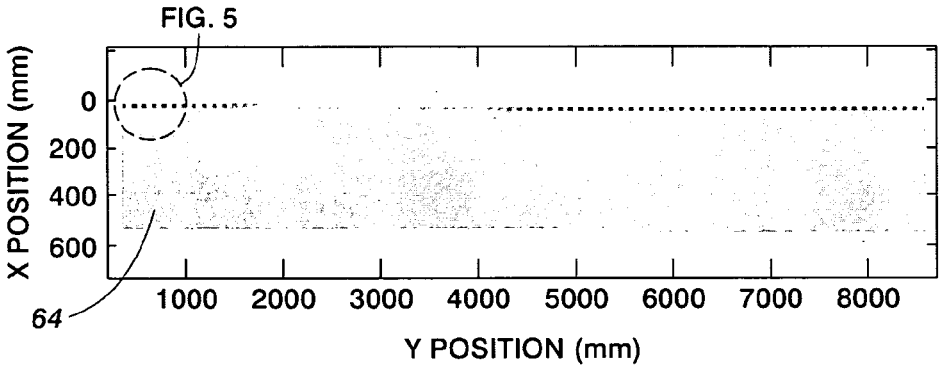
FIG. 4 shows a toner image with a row of registrations marks adjacent the toner image in accordance with an embodiment of the present disclosure.
Figure 5:
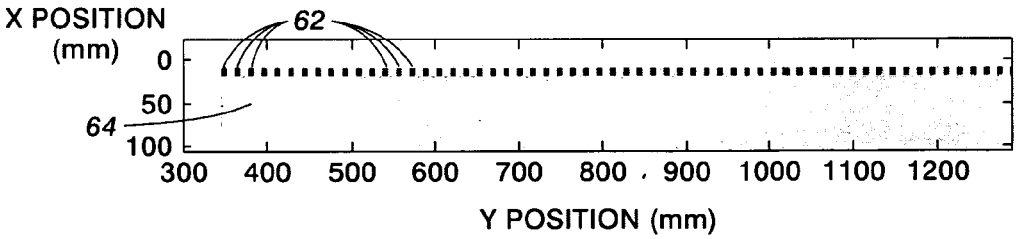
FIG. 5 shows a detailed view of a portion of the toner image with the row of registrations marks adjacent the toner image in accordance with an embodiment of the present disclosure.

FIG. 4 shows a toner image with a row of registration marks adjacent to toner image, and FIG. 5 shows a detailed view of a portion of the toner image with the row of the registration marks.

In one embodiment, the process direction misregistration and the cross-process direction misregistration between the color images is calculated using a set of average positions of the registration marks for each color image. Each average position is an average of a set of positions of the plurality of registration marks within each color image. The positions in the process and cross-process direction within each color can be averaged to determine an average process and cross-process position of each color respectively at two (e.g., lateral or cross-process positions) or more positions along the toner image. In one embodiment, any averaging technique as would be appreciated by one skilled in the art may be used. For example, the first ten registration marks in the lateral end for Cyan may be averaged to determine an average process position and cross-process position for Cyan on one lateral end. Similarly, the last ten registration marks in the other lateral end for Cyan may be averaged to determine an average process and cross-process position for Cyan on the other lateral end.

In one embodiment, by knowing where the positions in the process direction and the cross-process direction of the registration marks (or averaged positions in the process direction and the cross-process direction of the registration marks) are supposed to be located, relative to a reference color (e.g., Cyan color for CMYK color model), the misposition of colors can be calculated and fed to any number of misregistration algorithms.

In one embodiment, a misregistration algorithm may include a Real-Time Image-on-image Correction (RTIC). The Real-Time Image-on-image Correction generally is a color registration algorithm that continually measures the misregistration between colors and performs periodic updates to the color registration actuators. This allows the color registration system to maintain color-to-color registration without having to stop the machine to re-run a color-registration convergence routine (i.e., RTIC runs while the customer job is printing).

The color registration system described in the present disclosure, and the resultant increased image printing system productivity and improved color to color registration performance, are useful in many printing applications.

Figure 6:
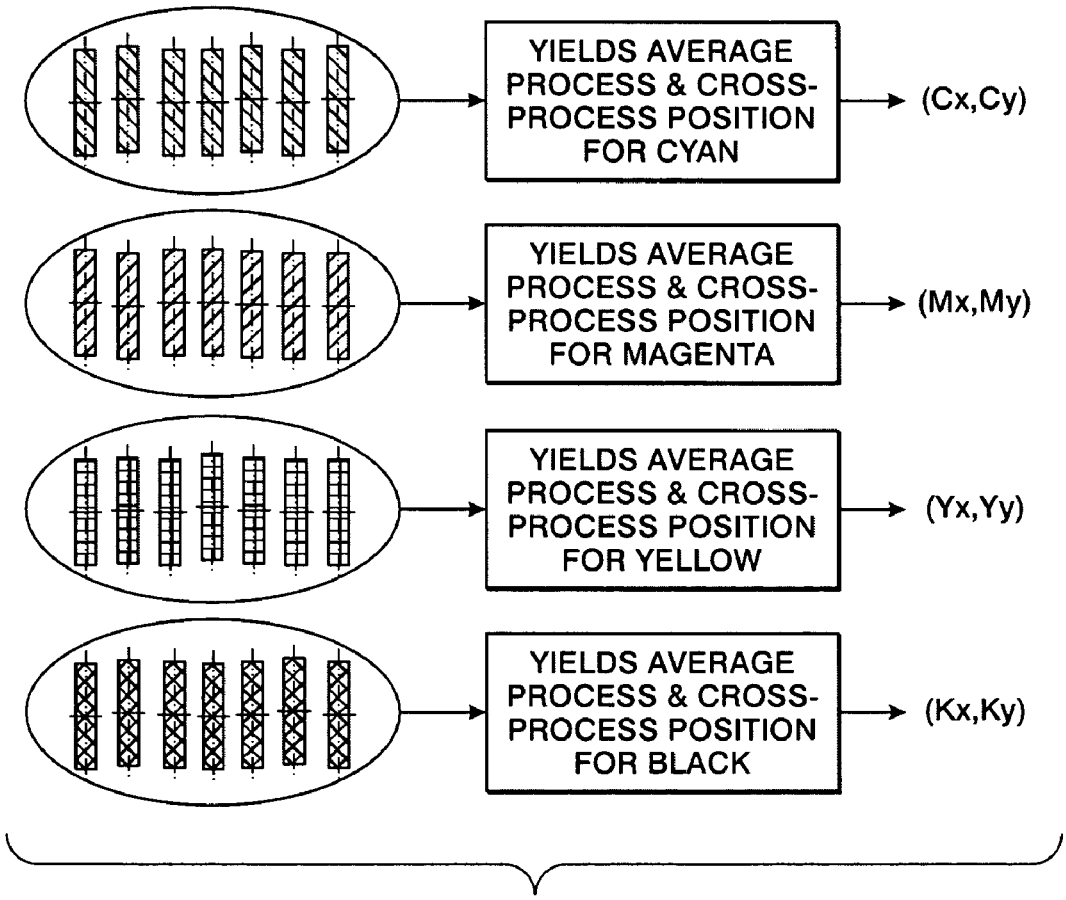
FIG. 6 shows registration marks for inter-document zones (IDZ's) used during the run time color registration control in accordance with an embodiment of the present disclosure.

In one embodiment, the registration marks described in the present disclosure are useful, for example, during run time color registration control. A cycle-up convergence (CUC) refers to a state of an image printing system where a controller of an image printing system completes several iterations to bring the image printing system to a desired state before starting the actual printing process. During the cycle-up convergence (CUC), the color registration may be calculated using the full-width toner images. However, during runtime state of the image printing system, the color registration algorithm (e.g., real time image-on-image registration control (RTIC)) cannot use the full-width toner images in the inter-document zones (IDZ's) because other color control systems place their own toned images in the inter-document zone (IDZ) adjacent to the color registration images, and there is insufficient room to place full-width toner color registration images. Therefore, during the runtime state of the image printing system, a row with a plurality of registration marks may be placed in the real time image-on-image registration control inter document zones at the two lateral or cross-process ends, only, such that they do not interfere with the other toned images located at the center of the image bearing surface. In such a case, a more simplified implementation of any control algorithm may be used during the run time state of the image printing system, since there are only two points being updated every real time image-on-image (IOI) registration control iteration, but still the real time image-on-image (IOI) registration control may be used to modify the color registration throughout the course of a job. FIG. 6 shows potential registration marks for inter-document zones (IDZ's) used during the run time color registration control.

Figure 7:
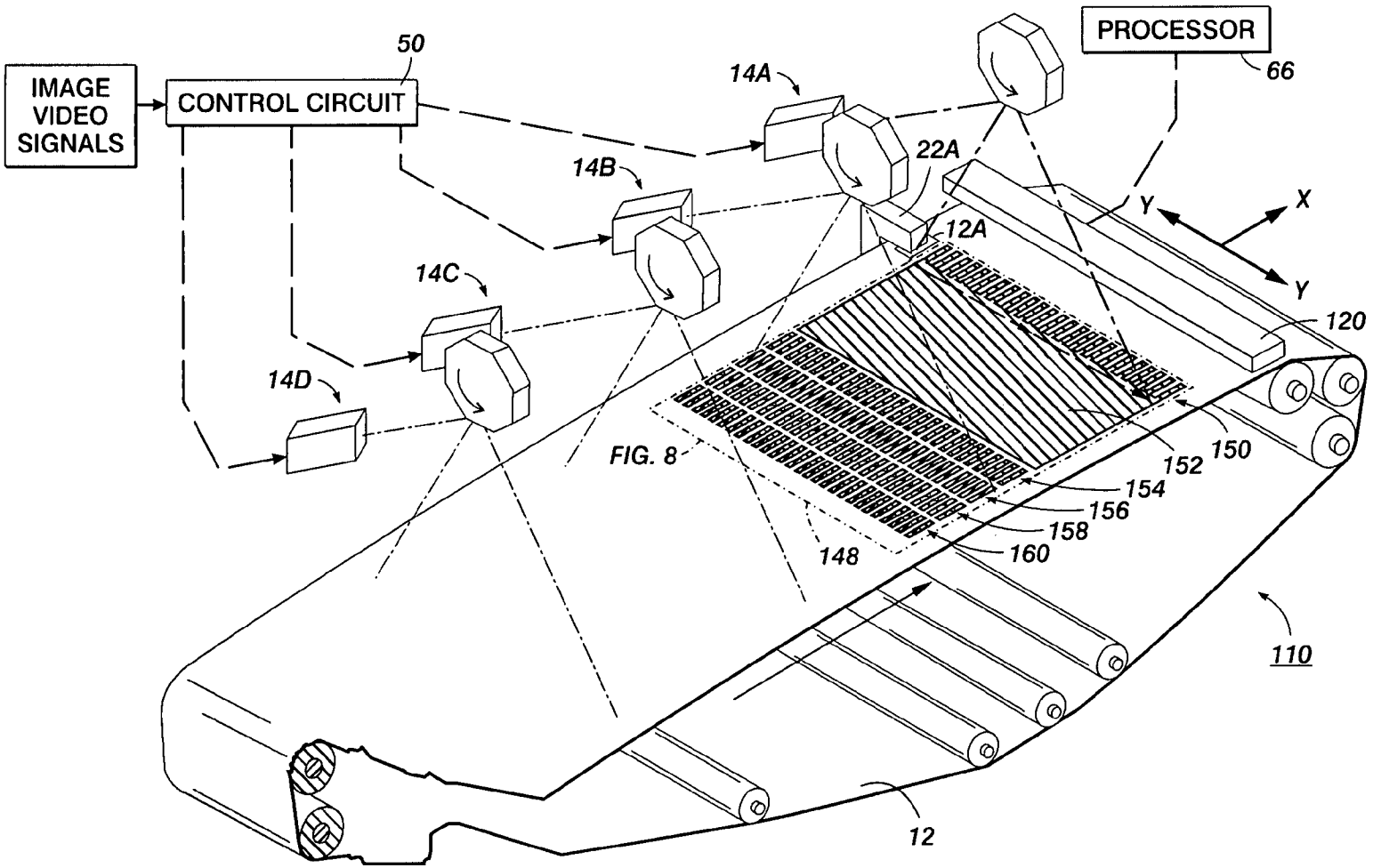
FIG. 7 shows a simplified schematic perspective view of part of the embodiment of FIG. 1 for better illustrating exemplary sequential ROS generation of plural color latent images and associated exemplary latent image registration marks for sensing by a linear array sensor (with development stations, etc., removed for illustrative clarity) in accordance with another embodiment of the present disclosure.
Figure 8:
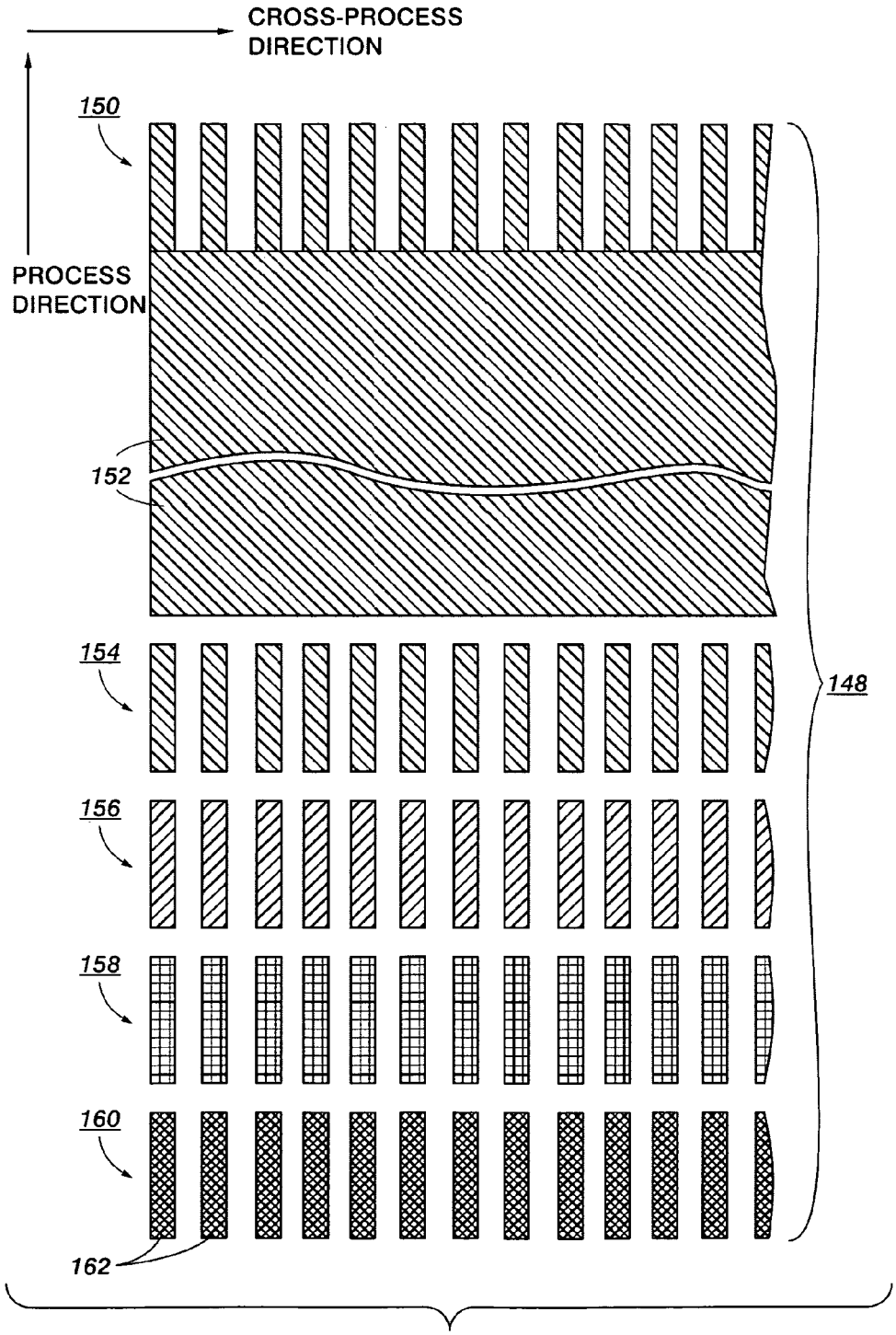
FIG. 8 shows a detailed view of registration marks and toner image in accordance with another embodiment of the present disclosure.

FIGS. 7 and 8 show another embodiment of the present invention. In this embodiment, a linear array sensor 120 is configured to perform at least three different functions of an image printing system 110, such as, for example, measuring the toner mass levels, measuring the misregistration between the colors images, and/or measuring the uniformity of developed images on an image bearing surface 112.

In this embodiment, the present disclosure proposes replacing the functionality of the color registration sensors (e.g., marks-on-belt (MOB) sensors) and the toner mass process control sensors (e.g., enhanced toner area coverage (ETAC) sensors) with the linear array sensor 120. Further, as in the previous embodiment, the linear array sensor 120 provides more versatility in the color registration measurements than the marks-on-belt (MOB) sensors. The linear array sensor 120 provides more measurement location options in the toner mass level measurements than the enhanced toner area coverage (ETAC) sensors. The present disclosure also eliminates the implementation and maintenance of three different sensors (enhanced toner area coverage (ETAC) sensor, marks-on-belt (MOB) sensor, and linear array sensor) which can be expensive.

Instead of scheduling three sets of toner images (e.g., that may have inherent limitations due to restrictions on cycle up time, and space availability on the image bearing surface 112), the present disclosure proposes generating a single toner image 148 in the inter-document zone (IDZ) on the image bearing surface 112 of the image printing system 110. The single toner image 148 is measured using the linear sensor array 120 in order to assess and update performance (e.g., using a closed loop control) of the image printing system 110. In one embodiment, the performance may include measuring the toner mass levels, measuring the misregistration between the colors images, and/or measuring the uniformity of developed images on an image bearing surface 112

As shown in FIGS. 7 and 8, the single toner image 148 placed in the inter-document zone (IDZ) on the image bearing surface 112 is detected by the linear array sensor 120 to provide measurements of the toner mass levels, the misregistration between the colors images, and/or the uniformity of developed images on the image bearing surface 112. The single toner image 148 includes a row 150 of registration marks, a toner region 152, and an ensemble of at least four rows 154-160 of registration marks.

In one embodiment, the row 150 of the registration marks and the toner region 152 will be different colors (e.g., depending upon what the toner region scheduler calls for, that is, the half-tone density of the toner region 152 may also vary depending upon what is required for measuring the developed toner image uniformity). Both the row 150 of the registration marks and the toner region 152 extend along the cross-process direction transverse to the process direction. The linear array sensor 120 detects both the row 150 of the registration marks and the toner region 152 and provides the positions of registration marks 162 (as shown in FIG. 8) and the toner region 152 in process and cross-process directions. These position measurements are used for determining the toner mass levels, and the uniformity of developed images on the image bearing surface.

U.S. Pat. No. 7,095,531, the entirety of which are incorporated herein by reference, describes printing a compensation pattern with a plurality of halftone regions that are lead by, trailed by, and separated by rows of fiducial marks, scanning and analyzing the compensation pattern, and generating a compensation parameter to compensate for streak defect when printing.

In one embodiment, the four rows 154-160 of registration marks are placed in the inter-document zone (IDZ) after the toner region 152. These four rows 154-160 of registration marks together are referred to as color registration ensemble. In one embodiment, the four rows 154-160 of registration marks extend along the cross-process direction transverse to the process direction. The linear array sensor 120 detects the rows 154-160 of the registration marks and provides the positions of registration marks 162 in process and cross-process directions that are used for measuring the misregistration between the colors, as explained in the previous embodiment.

In one embodiment, the color mode of the linear array sensor 120 may be switched between detecting the row 150 of the registration marks and the toner region 152, and detecting the ensemble with the four rows 154-160 of the registration marks. In one embodiment, the row 150 of the registration marks and the toner region 152 are measured using one of the color channels (RGB), and the ensemble with the four rows 154-160 of the registration marks are measured in the mono mode. In one embodiment, the size of the rows 150, 154-160 of registration marks and the toner region 152 may be modified to optimize for a given inter-document zone (IDZ) size and process direction sensor resolution.

In one embodiment, scheduling of the toner image 148 may be performed such that the toner region 152 and the rows 150, 154-160 of registration marks may be printed in every inter-document zone (IDZ) and/or panel during cycle-up convergence (CUC) and also in every inter-document zone (IDZ) during run time, and thereby increasing the frequency resolution potential of the corrections.

The term "reproduction apparatus" or "printer" as alternatively used herein broadly encompasses various printers, copiers or multifunction machines or systems, xerographic or otherwise, unless otherwise indicated or defined in a claim. The term "sheet" herein refers to a usually flimsy physical sheet of paper, plastic, or other suitable physical substrate for images, whether precut or web fed. A "copy sheet" may be abbreviated as a "copy" or called a "hardcopy". A "print job" is normally a set of related sheets, usually one or more collated copy sets copied from a set of original document sheets or electronic document page images, from a particular user, or otherwise related.

While the present disclosure has been described in connection with what is presently considered to be the most practical and preferred embodiment, it is to be understood that it is capable of further modifications and is not to be limited to the disclosed embodiment, and this application is intended to cover any variations, uses, equivalent arrangements or adaptations of the present disclosure following, in general, the principles of the present disclosure and including such departures from the present disclosure as come within known or customary practice in the art to which the present disclosure pertains, and as may be applied to the essential features hereinbefore set forth and followed in the spirit and scope of the appended claims.

What is claimed is:

1. A method for monitoring an image printing system that prints color images on an image transfer surface movable in a process direction, the method comprising:

placing marking material to form a row comprising a plurality of registration marks on the image transfer surface, wherein each row of registration marks extends along a cross-process direction transverse to the process direction;

detecting a position of each registration mark using a linear array sensor extending in the cross-process direction, wherein the position of each registration mark is detected in both the process and cross-process directions;

determining a process, direction misregistration between the registration marks of each row in the process direction; and determining a cross-process direction misregistration between registration marks from each of the rows.

2. The method of claim 1, further comprising determining a correction function based on the process direction misregistration and cross-process direction misregistration to provide accurate registration of color images on the image transfer surface.

3. The method of claim 1, wherein the color images on the image transfer surface are color separations of a color model being accurately superimposed to form full color images.

4. The method of claim 3, wherein the color model is selected from the group consisting of RGB (red, green, blue) color model, CMY (cyan, magenta, yellow) color model, CMYK (cyan, magenta, yellow, black) color model, HSB (Hue, Saturation, Brightness) color model, HLS (Hue, Lightness, Saturation) color model, and CIE L*a*b (Lab) color model.

5. The method of claim 1, wherein the cross-process direction misregistration further includes an offset in the process direction.

6. The method of claim 5, wherein the offset is an absolute position of a reference color image with respect to a fixed position of an image printing device in the process direction.

7. The method of claim 1, wherein the process direction misregistration and the cross-process direction misregistration between the color images is calculated using a set of average positions of the registration marks for each color image, wherein each average position is an average of a set of positions of the plurality of registration marks within each color image.

8. The method of claim 1, wherein the image transfer surface is at least one of a photoreceptor drum, a photoreceptor belt, an intermediate transfer belt, an intermediate transfer drum, and other image transfer surfaces.

9. The method of claim 1, wherein the linear array sensor is a full width array (FWA) sensor.

10. The method of claim 1, wherein each registration mark comprises a cross mark comprising two straight lines intersecting each other at right angles, wherein the position in the process and the cross-process directions of each registration mark is determined at the intersection of the two straight lines of the cross mark.

11. An image printing system, the system comprising:

a print engine configured to place marking material to form a row comprising a plurality of registration marks on the image transfer surface, wherein each row of registration marks extends along a cross-process direction transverse to the process direction;

a linear array sensor adjacent the image transfer surface and extending in the cross-process direction, wherein the linear array sensor configured to detect a position of each registration mark, and wherein the position of each registration mark is detected in both the process and cross-process directions; and a processor configured to determine:

(a) a process direction misregistration between the registration marks of each row in the process direction; and (b) a cross-process direction misregistration between registration marks from each of the rows.

12. The system of claim 11, the processor is further configured to determine a correction function based on the process direction misregistration and cross-process direction misregistration to provide accurate registration of color images on the image transfer surface.

13. The system of claim 11, wherein the color images on the image transfer surface are color separations of a color model being accurately superimposed to form full color images.

14. The system of claim 13, wherein the color model is selected from the group consisting of RGB (red, green, blue) color model, CMY (cyan, magenta, yellow) color model, CMYK (cyan, magenta, yellow, black) color model, HSB (Hue, Saturation, Brightness) color model, HLS (Hue, Lightness, Saturation) color model, and CIE L*a*b (Lab) color model.

15. The system of claim 11, wherein the cross-process direction misregistration further includes an offset in the process direction.

16. The system of claim 15, wherein the offset is an absolute position of a reference color image with respect to a fixed position of an image printing device in the process direction.

17. The system of claim 11, wherein the process direction misregistration and the cross-process direction misregistration between the color images is calculated using a set of average positions of the registration marks for each color image, wherein each average position is an average of a set of positions of the plurality of registration marks within each color image.

18. The system of claim 11, wherein the image transfer surface is at least one of a photoreceptor drum, a photoreceptor belt, an intermediate transfer belt, an intermediate transfer drum, and other image transfer surfaces.

19. The system of claim 11, wherein the linear array sensor is a full width array (FWA) sensor.

20. The system of claim 11, wherein each registration mark comprises a cross mark comprising two straight lines intersecting each other at right angles, wherein the position in the process and the cross-process directions of each registration mark is determined at the intersection of the two straight lines of the cross mark.

* * * * *